US006042024A

United States Patent [19]

Gilmore

[11] Patent Number: 6,042,024

[45] Date of Patent: Mar. 28, 2000

[54] ADHESIVE DISPENSING SYSTEM

[76] Inventor: Darren M. Gilmore, 2 Oakwood Ave., North Haledon, N.J. 07508

[21] Appl. No.: 09/212,642

[22] Filed: Dec. 16, 1998

[51] Int. Cl.[7] ..... B05B 15/06

[52] U.S. Cl. ..... 239/290; 239/273; 239/280; 239/300; 239/302; 239/328; 239/379; 222/105; 222/185.1; 285/148.23

[58] Field of Search ..... 239/273, 280, 239/290, 300, 302, 320, 323, 328, 379, 588; 222/105, 185.1, 330, 183; 285/148.23

[56] References Cited

U.S. PATENT DOCUMENTS

| | | | |
|---|---|---|---|
| 1,030,306 | 6/1912 | Hull | 285/148.23 X |
| 2,154,363 | 4/1939 | Seybold . | |
| 2,831,610 | 4/1958 | Dennie . | |
| 3,052,417 | 9/1962 | Daniel . | |
| 3,081,911 | 3/1963 | Scholle . | |
| 3,096,225 | 7/1963 | Carr et al. . | |
| 3,243,084 | 3/1966 | Stegner . | |
| 3,554,256 | 1/1971 | Anderson . | |
| 3,895,742 | 7/1975 | Wulbern . | |
| 3,945,534 | 3/1976 | Ady . | |
| 4,020,975 | 5/1977 | Stauffer . | |
| 4,090,514 | 5/1978 | Hinck et al. . | |
| 4,375,864 | 3/1983 | Savage . | |
| 4,527,716 | 7/1985 | Haas et al. . | |
| 4,551,139 | 11/1985 | Plaas et al. . | |
| 4,603,793 | 8/1986 | Stern . | |
| 4,887,852 | 12/1989 | Hancock | 285/148.23 X |
| 5,263,646 | 11/1993 | McCauley | 239/588 |
| 5,265,766 | 11/1993 | Kurtzahn et al. . | |
| 5,316,215 | 5/1994 | Mitchell . | |
| 5,318,198 | 6/1994 | Micek et al. . | |
| 5,458,379 | 10/1995 | Hamada et al. | 285/148.23 X |
| 5,535,779 | 7/1996 | Huang . | |

*Primary Examiner*—Andres Kashnikow
*Assistant Examiner*—Robin O. Evans
*Attorney, Agent, or Firm*—Weingram & Associates, P.C.

[57] ABSTRACT

A system for dispensing and applying an adhesive to a work piece is provided which includes a flexible tote elevated above an underlying surface to provide a gravity head for feeding the adhesive to a spray gun for admixture with compressed air so that the adhesive can be applied in a predetermined pattern. Additional features of the invention call for a fitting disposed in the adhesive conduit to reduce the flow path for the adhesive being dispensed, and a valve to vent the system of unwanted gas such that adhesive flow from the flexible tote is continuous, uniform and uninterrupted.

34 Claims, 6 Drawing Sheets

ADHESIVE DISPENSING SYSTEM

BACKGROUND OF THE INVENTION

1. Field of the Invention

The present invention relates to apparatus and systems for dispensing adhesives by gravity.

2. Description of the Related Art

Devices and systems are known to employ gravity feed to dispense liquid products. For example:

| U.S. Pat. No. | Inventors (s) |
|---|---|
| 2,831,610 | Dennie |
| 3,052,417 | Daniel |
| 3,081,911 | Scholle |
| 3,554,256 | Anderson |
| 3,895,742 | Wulbern |
| 3,945,534 | Ady |
| 4,020.975 | Stauffer |
| 4,090,514 | Hinck et al. |
| 4,551,139 | Plaas et al. |
| 4,603,793 | Stern |

U.S. Pat. No. 2,831,610 to Dennie discloses a liquid dispensing container consisting of a carton in which a flexible bag is disposed and secured to a nozzle from which the contents of the flexible bag can be dispensed.

U.S. Pat. No. 3,052,417 to Daniel discloses a dispensing apparatus consisting of an elongated body into which detergent is gravity fed, and an inclined tubular arm connected to the body portion in communication therewith through which water is discharged from the body portion. The structure of the device is such that mixing of the concentrate (detergent) and water is accomplished subsequent to the discharge from the instant spray device.

U.S. Pat. No. 3,081,911 to Scholle discloses a drainage fitting for a collapsible container.

U.S. Pat. No. 3,554,256 to Anderson discloses a flexible intravenous container consisting of a sealed flexible bag in which intravenous fluid is contained for being gravity fed through an outlet connector.

U.S. Pat. No. 3,895,742 to Wulbern discloses a collapsible container consisting of a flexible membrane in which water may be carried. Straps extend along an exterior of the membrane to give it shape and support when the membrane is inflated with water. Water is dispensed through the hose substantially under gravity feed.

U.S. Pat. No. 3,945,534 to Ady discloses a food preparation and dispensing system consisting of an outer housing and an inner housing extending through an opening in the outer housing, and a food package arranged in the inner housing. A valve assembly is provided to control dispensing of the contents of the food package from the inner housing.

U.S. Pat. No. 4,020,975 to Stauffer discloses a wall-mountable dispensing device for bulk and encapsulated materials consisting of a cylindrical housing adapted to telescopically receive a cup in which a capsule is disposed. Threading of the housing along the cup expels contents in the cup or contents in the capsule through a spout at a base of the cup.

U.S. Pat. No. 4,090,514 to Hinck et al. discloses a pressure infusion device consisting of a pair of inflatable sheets which are foldable over a liquid-filled plastic bag, the sheets being inflated to exert pressure on the bag and expel the contents therefrom through an outlet of the bag.

U.S. Pat. No. 4,551,139 to Plaas et al. discloses a method and apparatus for burned wound treatment consisting of a container for the treating agent, a spray nozzle, a roller to urge the contents of the container to an outlet therefrom, and a pump unit to convey a pressurized flow of the agent from the container outlet to the spray nozzle. The treating agent is isolated from ambient air.

U.S. Pat. No. 4,603,791 to Stern discloses a coupling device for connecting a material outlet to a packing.

There is a need for a hermetically sealed riser system which permits water based adhesive to flow under the effective of gravity to a dispensing device such as a spray gun, where it is mixed with water to be atomized and produce a fine adhesive spray for application to a work piece. There is also a need for an apparatus which is constructed from kit form easily and inexpensively, and obtains the advantages of kit construction, i.e. replacement parts are easily obtained and installed in the existing system.

OBJECTS AND SUMMARY OF THE INVENTION

It is an object of the present invention to provide a system for delivering fluids, such as a water based adhesive, under the effect of gravity to a work surface.

It is another object of the present invention to provide a system which delivers water based adhesive under low pressure to a work surface to be bonded.

It is another object of the present invention to provide a system for delivery of the water borne adhesive such that a visual inspection can be made to determine the amount of adhesive remaining in the system.

It is another object of the present invention to provide a system to deliver a water borne adhesive to one or a plurality of spray stations without using pumps, regulators or pressure tanks to deploy the adhesive.

It is another object of the present invention to provide a system to administer a water borne adhesive, wherein a container for the adhesive is elevated off a shop or factory floor thereby providing additional space on the shop and/or factory floor.

It is another object of the present invention to provide a system for dispensing a water borne adhesive, wherein the system is easily retrofitted to existing manufacturing facilities.

It is another object of the present invention to provide a system for dispensing water borne adhesives wherein the adhesive is segregated and hermetically sealed from contaminants throughout the system until dispensed from a spray gun of the system.

It is another object of the present invention to provide an adhesive dispensing system which dispenses a water based adhesive, thereby reducing hazardous conditions in a manufacturing environment.

It is another object of the present invention to provide a water based adhesive dispensing system which is assembled from a kit so that it can be delivered to facilities at remote locations and assembled relatively easily for mounting to a support or stanchion at the facility.

It is another object of the present invention to provide an adhesive dispensing system with an accelerating means interposed in the adhesive line to increase the flow of the adhesive through the line to be dispensed under the force of gravity.

It is a another object of the present invention to provide an adhesive dispensing system with gas venting means at the discharge conduit for the adhesive container to vent any gas trapped in the conduit where the conduit is branched to facilitate a uniform, continuous and reliable flow for dispensing of the adhesive.

It is another object of the present invention to provide an adhesive dispensing system with a means for bleeding gas from the adhesive line, particularly where the adhesive line is connected to the dispensing means for the system so that the system can be primed.

It is another object of the present invention to provide an adhesive dispensing system constructed of rigid and/or flexible piping to convey the adhesive while substantially reducing the effective frictional loss of the adhesive to the piping.

It is a further object of the present invention to provide an adhesive dispensing system with a closure means to secure the adhesive conduit and the adhesive container from exposure to possible contaminants or unwanted gas when either the container or system riser is to be replaced.

The present invention includes an apparatus for dispensing adhesive having a dispensing means for dispensing the adhesive, high pressure air supply means and adhesive supply means connected to the dispensing means, hermetically sealed container for the adhesive, an elevation means to support the hermetically sealed container above the dispensing means, an adhesive delivery means for conveying the adhesive from the hermetically sealed container to the dispensing means, and a control means operatively associated with the dispensing means to simultaneously control the high pressure air and the adhesive to enable dispensing of the adhesive in a predetermined pattern.

Another feature of the present invention includes accelerating means interposed the adhesive conduit to constrict the passageway and thereby maintain the flow rate of the adhesive in a conduit of increased length under the effect of gravity.

A still further feature of the present invention calls for providing gas venting means interposed in the conduit between the adhesive container (or tote) and a position where the conduit is branched so that any gas in the conduit can be vented for the flow of the adhesive from the tote to be smooth, continuous and uninterrupted.

Other features of the present invention will be described in more detail below with respect to the description of the preferred embodiments of the present invention.

BRIEF DESCRIPTION OF THE DRAWINGS

For a more complete understanding of the present invention, reference may be had to the detailed description of the preferred embodiments taken in connection with the accompanying drawings, of which.

DETAILED DESCRIPTION OF THE PREFERRED EMBODIMENTS

Figure 1:
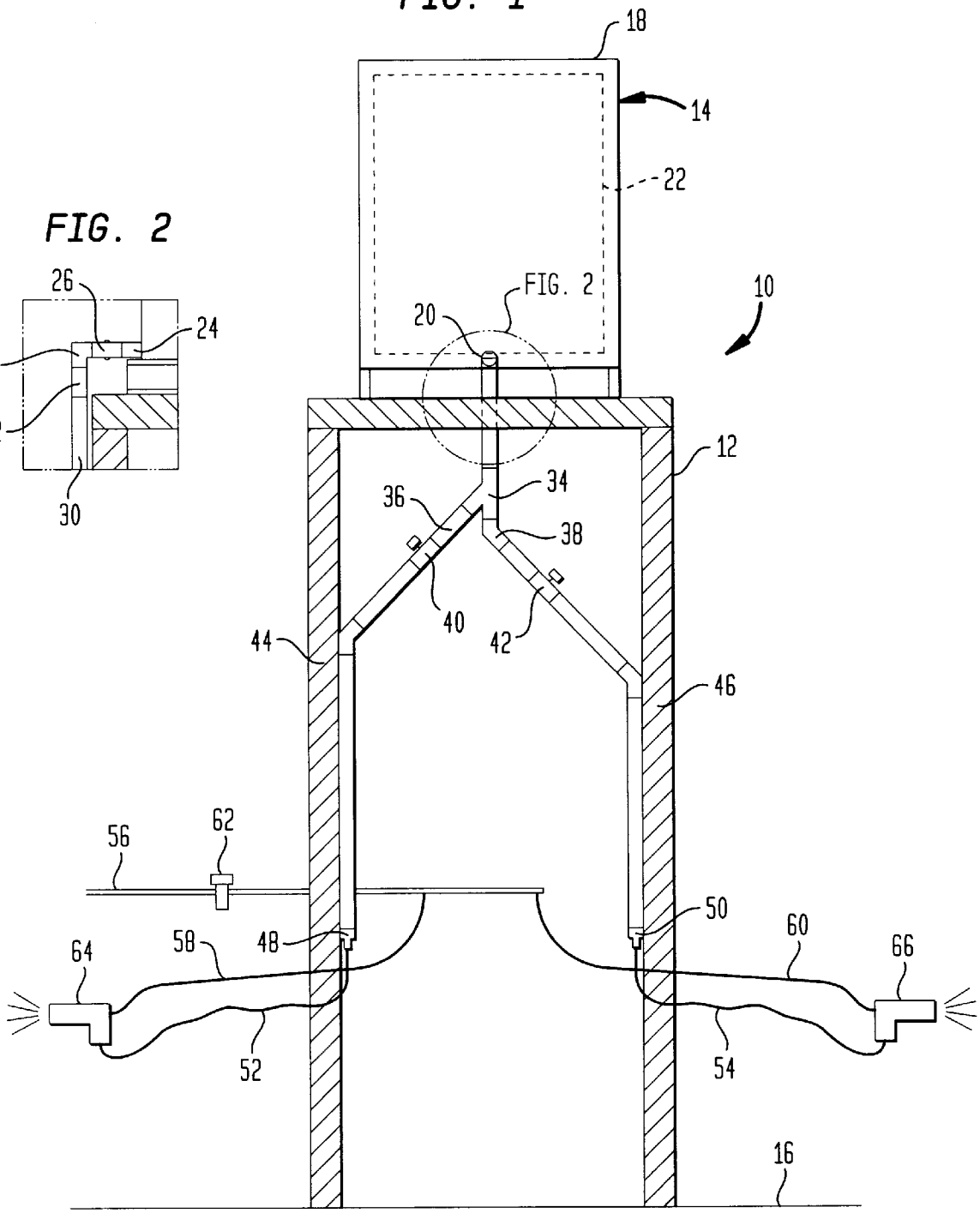
FIG. 1 is a partial cross-sectional view of an adhesive dispensing system according to the present invention.
Figure 2:
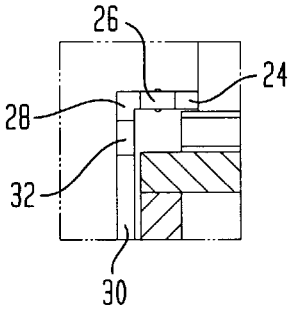
FIG. 2 is a view of a portion of the system shown in FIG. 1.

Referring to FIGS. 1 and 2, a dispensing system according to the present invention is indicated generally at 10 and includes a support means such as a platform 12 for supporting a container 14 off an underlying surface 16, such as a factory floor. The dispensing system 10 can be used with many different liquids, or liquid compositions, such as paints. It is well suited for dispensing liquid adhesive and particularly, waterborne adhesive.

The container 14 consists of a cardboard shell 18 having a port 20 formed therein. A flexible hermetically sealed tote 22 or bladder is disposed in the container and is capable of storing from five (5) gallons to three hundred and thirty (330) gallons of a water based adhesive. The tote 22 is provided with a hermetically sealed valve 24 disposed near a bottom of the tote 22 to be in registration with the port 20 of the cardboard shell 18.

The valve 24 of the tote has a reciprocating valve stem which when depressed inward of the tote 22 provides a passageway for the adhesive to flow from inside the tote 22 out through the valve 24. When the valve stem 24 is pulled outward away from the tote 22, the passageway for the adhesive is secured and the adhesive is retained in the tote 22. Cutter valves or similar types of valves can also be used.

The valve 24 is connected to a quick disconnect coupling 26, which in turn can be connected to an elbow joint 28, so that piping 30 or a riser for the adhesive now extends downward toward the factory floor 16.

The piping 30 is part of the dispensing means, preferably fixed and rigid, and is formed with a substantially transparent hose portion 32 as an indicator means so that the amount and flow of the adhesive can be viewed from the exterior of the system 10. The piping 30 is hermetically sealed. The transparent portion can consist of a separate piece interposed along the piping 30 beneath the elbow joint 28. The piping 30 below the transparent portion 32, is then bifurcated at 34 into a first branch 36 and a second branch 38 for the flow of the adhesive. Each one of the corresponding branches 36,38 is also provided with a corresponding ball valve 40, 42.

As shown in FIG. 1, the branches 36,38 are led down legs 44,46 of the support platform 12 and can, if desired, be strapped to a corresponding one of the legs for additional support. The lower end of each one of the branches 36,38 is provided with a corresponding ball valve 48,50. Hoses 52,54 are connected to a corresponding one of the ball valves 48,50 and are each directed to a respective dispensing means, such as spray guns 64,66. The spray guns 64,66 simultaneously actuate the dispensing of adhesive and high pressure air to form a predetermined spray pattern of the adhesive.

Compressed air for the system is provided through a compressed air line 56. A control means (not shown) controls the flow of air through the line 56. The compressed air line 56 functions as a manifold to which a pair of air hoses 58,60 are connected to deliver the compressed air to a respective one of the spray guns 64,66. Each one of the spray guns 64,66 also functions as a control means to control the simultaneous discharge of compressed air admixed with the adhesive.

An oil and water extractor 62 is interposed along the compressed air line 56. Regulators are used for atomizing air for the system.

A preferred construction of the system calls for the support platform 12 to be approximately 10' to 16' off the underlying surface 16.

The provision of the transparent hose 32 is to permit a view of the level of the adhesive remaining in the pressure "head" of the system to provide the gravity feed force necessary for the invention.

The ball valves 40,42 operate as safety valves to restrict the flow of the adhesive if only one of the first branch 36 and second branch 38 is to be employed during an adhesive spraying operation.

The use of the oil and water extractor 62 prevents the interjection of contaminants into the system which would be detrimental to and most likely dilute the adhesive composition which is contained premixed in the tote 22. Contaminants such as oil and water in the compressed air detrimentally impact on the atomization of the adhesive when it is mixed with the compressed air for application to a surface to be bonded.

The tote 22 is disposable or can be reused after it has gone through the proper recycling procedures.

Preferable dimensions for each of the elements of the system are as follows: the quick disconnect coupling 26 preferably 2" PVC, and the transparent flexible hose is preferably a 2" nylon.

The support platform 12 is preferably no less than 10' above the surface 16 and should be able to support as much 2,500 lbs., if the 2500 lb. tote 22 is being used. Steel or other similar alloys are preferred to construct the support platform 12. The piping 30 is preferably 2" PVC piping, Schedule 40 or 80. The ball (40 or 80) valves 48,50 are stainless steel or PVC ball valves with a ½" OD hose barb. The air hoses 58,60 are conventional air hoses, as are the HVLP (high volume, low pressure) spray guns 64,66. The air pressure is approximately 25–35 psi coming into the spray guns and is reduced to preferably 6–8 psi for the atomizing air to deploy the adhesive to a work piece. The adhesive hoses 52,54 are preferably ½" 1D nylon fluid hoses.

Figure 3:
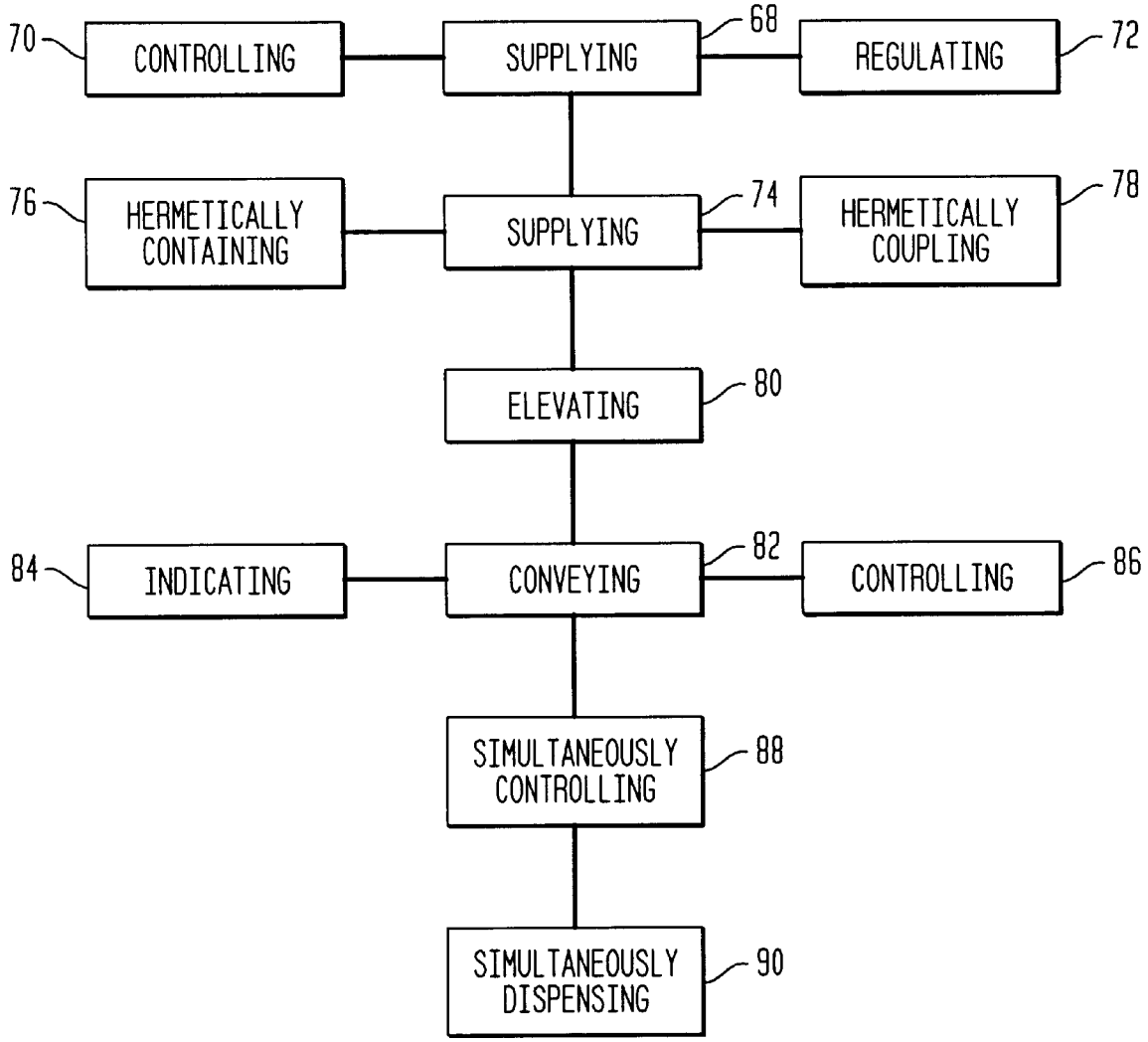
FIG. 3 is a flow chart of steps employed to carry out the method according to the present invention.

A flow chart for a method of steps to dispense a liquid or an adhesive according to the present invention is shown in FIG. 3. The method according to the present invention includes the steps of supplying 68 the high pressure air to the dispensing means and in doing so, controlling 70 and regulating 72 the supply of the high pressure air. The adhesive is then supplied 74, including the steps of hermetically containing 76 and hermetically coupling 78 the supply of the adhesive to the dispensing means. The supply of adhesive is elevated 80 so that during conveyance 82 of the adhesive under the effect of gravity to the dispensing means, the flow of the adhesive is indicated 84 and accordingly controlled 86 as it travels through the piping system to the dispensing apparatus. The next step is to simultaneously control 88 the contact of the high pressure air with the adhesive so that the adhesive and high pressure air can be simultaneously dispensed 90 in a predetermined spray pattern.

FIGS. 4–8 are directed to additional embodiments of the adhesive dispensing system according to the present invention. Elements illustrated in FIGS. 4–8 which correspond to the elements described above with respect to FIGS. 1–3 have been designated by corresponding reference numerals increased by 200 and 300, respectively. The embodiments of FIGS. 4–8 are designed for use in the same manner as the embodiment of FIGS. 1–3, unless otherwise stated.

Figure 4:
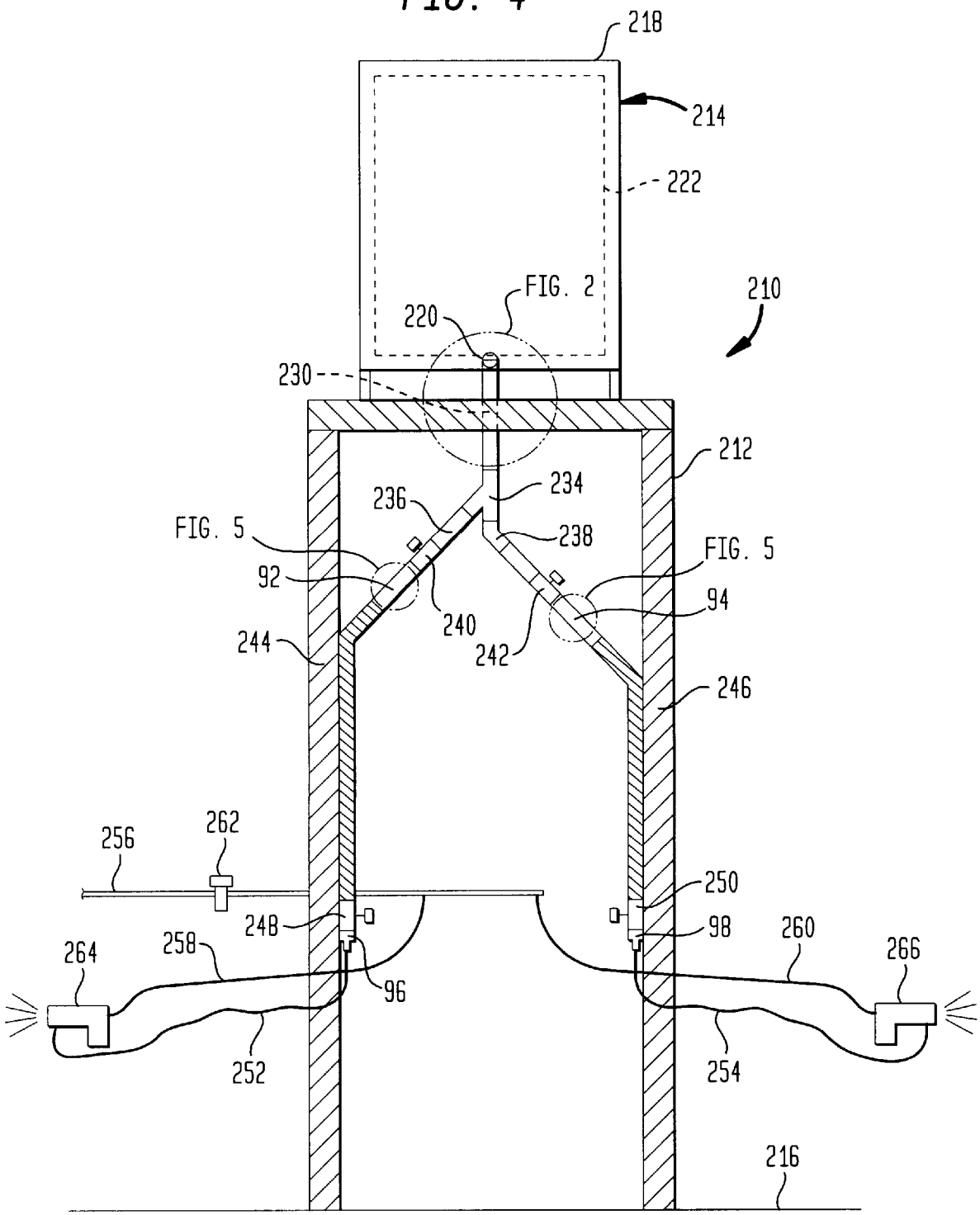
FIG. 4 is a partial cross-sectional view of another embodiment of an adhesive dispensing system according to the present invention.
Figure 5:
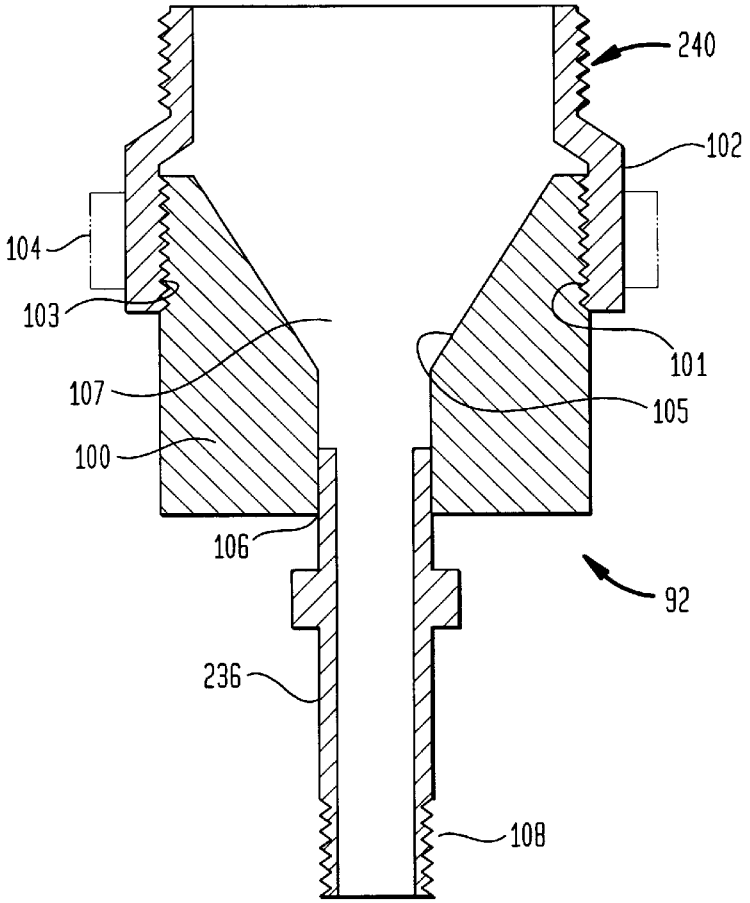
FIG. 5 is a cross-sectional view of a reduction member for the present invention.

FIGS. 4 and 5 disclose another embodiment of an adhesive dispension system according to the present invention shown generally at 210. This embodiment incorporates additional features for controlling the flow of the adhesive from the tote 222. In particular, there is shown a reducer element at 92,94,96,98 (92–98) interposed along the conveying means 230 preferably immediately after any one of the ball valves 240,242,248,250. Each one of the reducers 92–98 is constructed to constrict the passageway of the conduit 236,238 immediately after the adjacent ball valve 240,242,248,250 to thereby impact upon the flow rate of the gravity fed adhesive as it proceeds to the dispensing means, i.e. the spray guns 264,266. The reducers 92–98 facilitate the releasable connection of the spray gun 264,266 hoses to the riser conduits.

Referring in particular to FIG. 5, and using the reducer element (the "reducer") 92 by way of example, the reducer 92 is connected to the downstream end of the ball valve 240. The reducer 92 includes a sleeve portion 100 which is constructed and arranged to fit into a mouth portion 102 of the adjacent ball valve 240. The "fit" can be by friction or with complimentary threaded regions at the sleeve portion 100 and the mouth portion 102, respectively. In either construction, a hermetic seal is provided. A band 104 or cincture 104 is constructed and arranged to encircle an exterior of the mouth portion 102 to be tightened down to provide for a hermetic seal between the mouth portion 102 of the ball valve 240 and the sleeve portion 100 of the reducer 92. The cincture 104 can be used when there are no threads 101,103. The cincture 104 is preferably of plastic or alloy construction. An interior wall 105 of the sleeve portion 100 defines a passageway 107 for the sleeve portion 100. The interior wall 105 tapers inward to constrict a diameter of the passageway 107 to funnel the passageway for communication with a discharge port 106 for the sleeve portion 100. The discharge port 106 is in communication with the conduit 236 and thereafter the adhesive hose 236. The hose 252 is threaded at 108 for connection to the hose 252 of adhesive gun 264, unless the ball valve 248 and reducer 96 are used.

With certain constructions, the reducers 96,98 include means for bleeding any gas in the system, which may occur when the conduit 252 is being connected to the spray gun 264. The bleeding means prevent retention of gas in the line so that the flow of adhesive through the conduit is uniform and uninterrupted.

Figure 6:
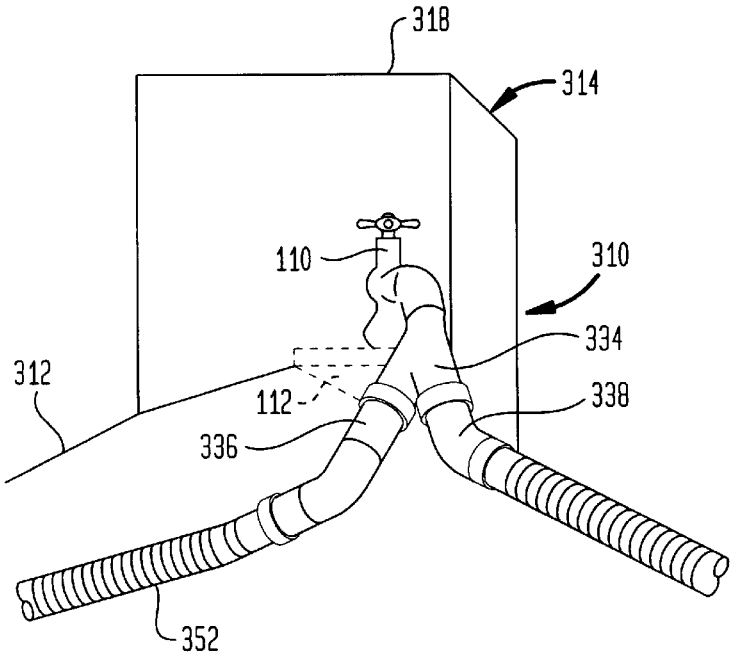
FIGS. 6 and 7 are partial views of another embodiment of an adhesive dispensing system according to the present invention.
Figure 7:
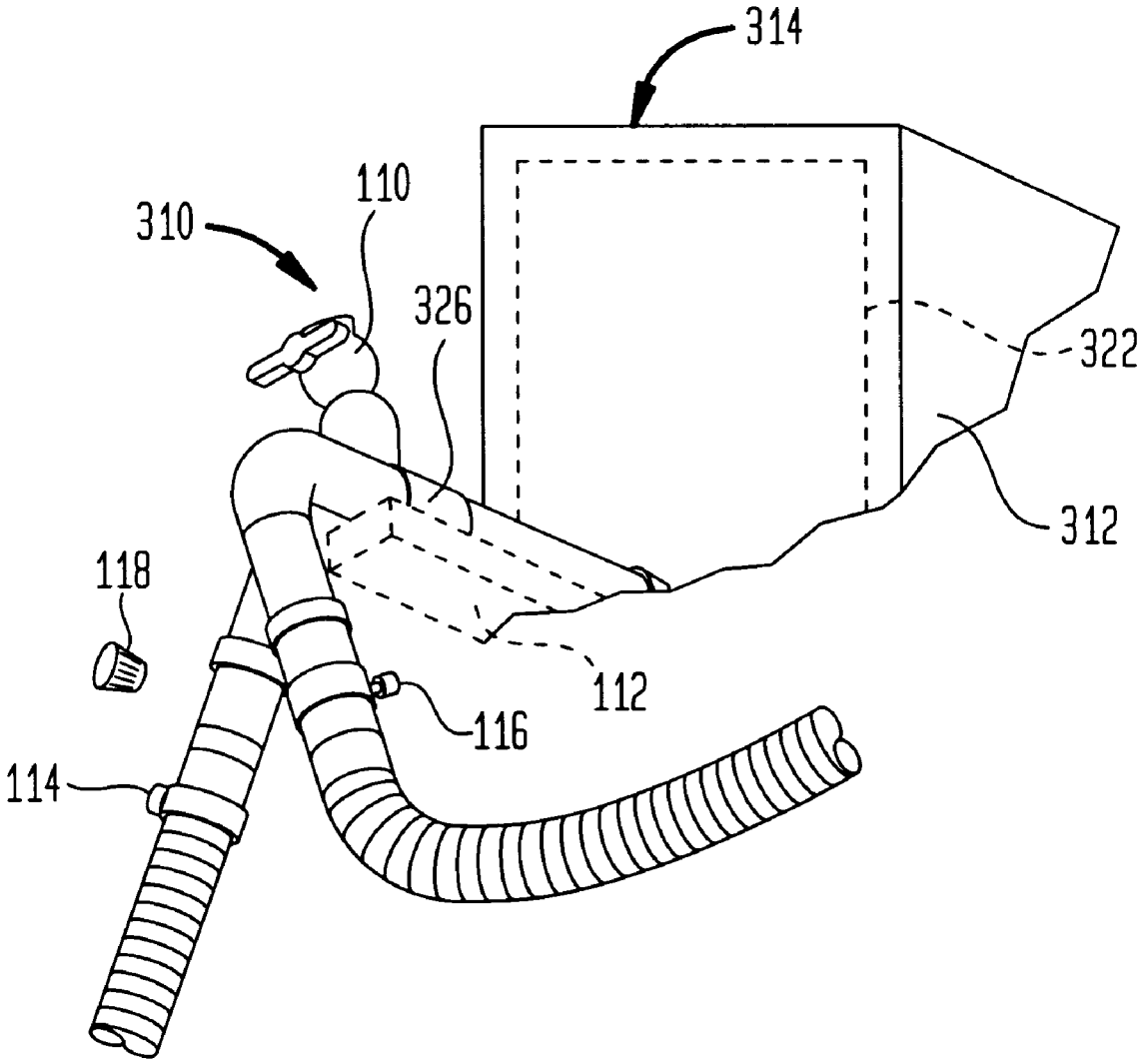

FIGS. 6 and 7 show still another embodiment of an adhesive dispensing system 310 according to the present invention. In this embodiment, the outlet 326 for the tote 322 is connected to a gas venting valve 110 for use with the adhesive dispensing system, particularly when the adhesive conduit is branched 334 to dispense adhesive to a plurality of stations. As shown in FIGS. 6 and 7, the valve 110 is in communication with the adhesive conduit 326. When the conduit outlet 326 is connected to a plurality of branches 336,338, there is the increased possibility of unwanted gas getting into the adhesive conduit and disrupting the smooth continuous flow and detrimentally impacting on the pressure of the adhesive. When the conduits 336,338 are first connected to the outlet valve of the tote, the valve 110 is opened for a few seconds to vent any gas that is in the adhesive conduit so that the flow of adhesive from the tote 332 will be smooth, uniform and uninterrupted.

Depending upon the position of the container 314 on the platform 312, it is preferred to provide for further support of the adhesive conduit 326 to compensate for the added weight of the valve 110. Therefore, a supporting member such as a brace 112 is disposed beneath the conduit 326 opposite the position of the valve 110.

In those instances where it is necessary to remove for replacement or repair one of the conduits 336,338, such can be accomplished by removing the conduit via a quick disconnect coupling at 114,116 and then inserting closure means such as a plug 118, into the conduit and venting any remaining gases in that branch. The plug 118 will also prevent unwanted particulate matter from being introduced into the system.

The use of the accelerating means, such as those shown in FIGS. 4 and 5, for example the reducer 92 or 96, permits use of wide flexible hoses 352 to convey the adhesive to the dispensing means, without excess frictional loss.

Figure 8:
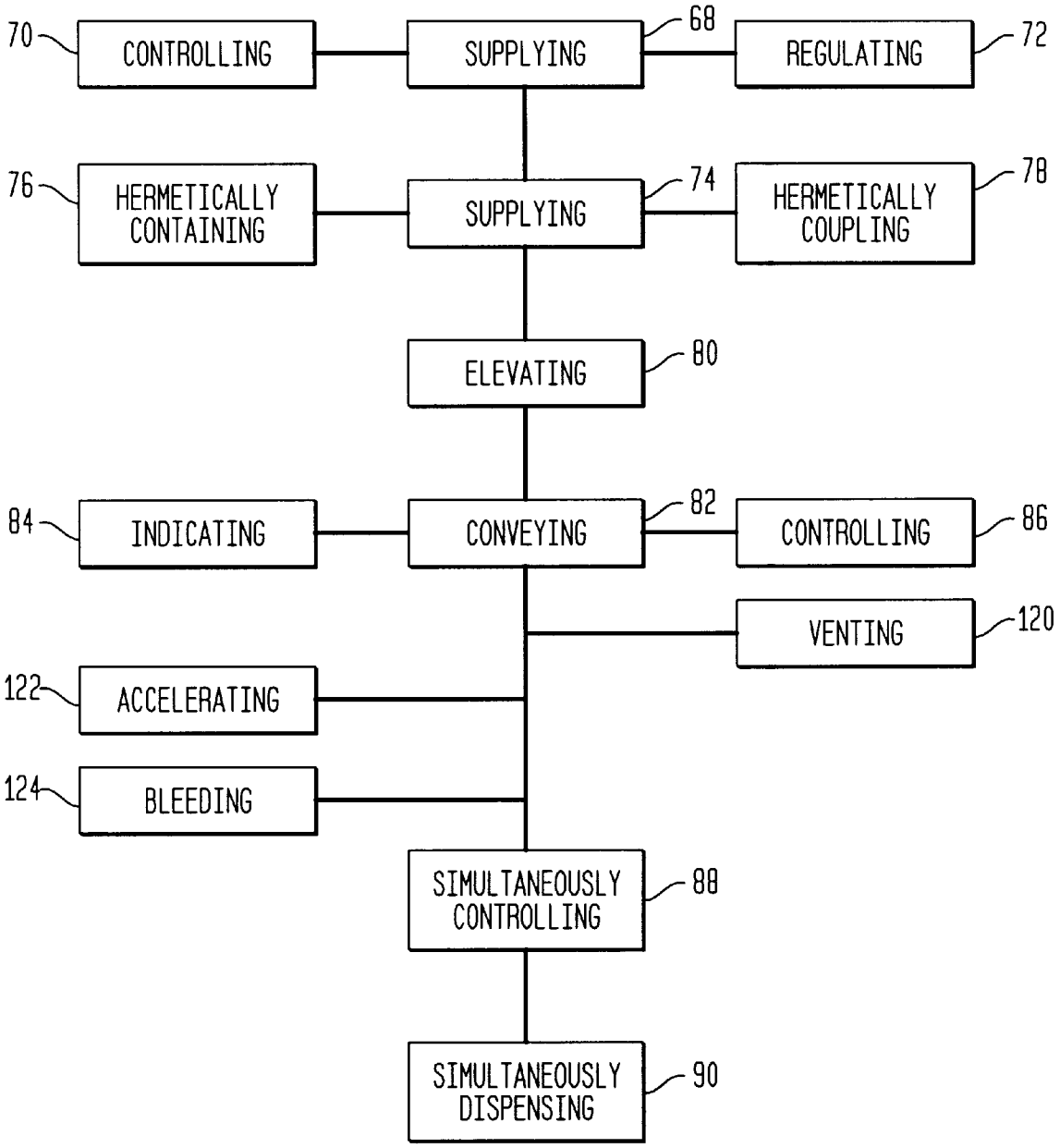
FIG. 8 is a flow chart of steps employed to carry out a method for other embodiments according to the present invention.

In FIG. 8, there is disclosed the additional advantageous steps for facilitating the flow of adhesive through the adhesive conduit for being dispensed onto the work piece. As the adhesive is dispensed from the tote for being conveyed 82, unwanted gas can be vented or purged 120 from the adhesive conduit to provide for the uniform and uninterrupted flow of the adhesive from the tote for dispensing 90. As discussed above, where a plurality of branches are connected to the tote, there is the possibility that gas will become trapped at the connection which could provide for air pockets or bubbles during the dispensing of the adhesive.

After the initial gas venting occurs, during the first connection of the tote 22,222,322 to one or a plurality of adhesive conduits, it is not necessary to further vent the line as it remains hermetically sealed and void of any additional gas. In the event that the adhesive lines, for example, 52,54 are removed from or replaced in the system, bleeding 124 of any gas in such lines is also carried out to ensure that the flow of adhesive is uniform and uninterrupted when the adhesive lines are reconnected to the system.

The speed of the adhesive dispensed is accelerated 122 during the conveyance through the riser. As discussed above with reference to the reducer elements 92–98, the passageway 107 of the conduit is reduced in diameter thereby constricting or reducing the flow path and sustaining the flow rate of the adhesive through the conduit. The result is that the adhesive accelerates through the hoses 252,254 prior to being dispensed. Acceleration is contingent upon the length of the hoses. The reducers provide for use of wide flexible piping without frictional loss of the adhesive as it flows through the piping. The reducers also facilitate changing the fluid dispensing lines 252,254.

The construction of the cardboard shell 18,218,318 and the tote 22,222,322 can be as an integral unit. Alternatively, the container 14,214,314 can be manufactured of a rigid material without using the flexible tote 22,222,322 at an interior thereof. Where an individual rigid container is used, it is provided with an air valve to bleed gas from an interior of the container.

It will be understood that the embodiments described herein are merely exemplary and that a person skilled in the art may make many variations and modifications without departing from the spirit and scope of the invention. All such modification and variations are intended to be included within the scope of the invention as defined in the appended claims.

What is claimed is:

1. An apparatus for dispensing adhesive, comprising:

dispensing means for dispensing adhesive, the dispensing means having:

regulating means for regulating a high pressure air supply to the dispensing means, positioning means for positioning the high pressure air supply with respect to the adhesive, actuating means for simultaneously actuating the dispensing of adhesive and high pressure air to form a predetermined spray pattern of the adhesive;

high pressure air supply means connected to said dispensing means, the high pressure air supply means including:

control means for controlling the high pressure air supply;

adhesive supply means connected to said dispensing means, the adhesive supply means including:

a hermetically sealed flexible bladder in which the adhesive is disposed, a container for containing the flexible bladder, and a hermetically sealed coupling extending from the flexible bladder through the container and providing a hermetically sealed conduit through which the adhesive is removed from the bladder, venting means for venting gas from the hermetically sealed conduit, elevational means for elevating the adhesive supply means;

bracing means for bracing the hermetically sealed coupling at the elevational means;

adhesive delivery means for delivering the adhesive from the hermetically sealed coupling to the dispensing means, the adhesive delivery means having:

a hermetically sealed vertically disposed conduit constructed and arranged as a riser for delivery of the adhesive, the riser having:

fixed piping having a first relatively large flow path, a quick disconnect coupling disposed between and interconnecting the hermetically sealed coupling of the container and the fixed piping, indicator means in communication with the fixed piping to indicate the flow of adhesive, first control means operatively associated with the fixed piping to control the flow of the adhesive through the fixed piping, the first control means including a ball valve;

restricting means connected to the fixed piping for restricting the passageway for the flow of the adhesive through the fixed piping;

flexible piping means connected to the fixed piping downstream from the restricting means and operatively associated with said dispensing means, the flexible piping means having a second flow path relatively narrower than the first flow path;

bleed means connected to the flexible piping means for bleeding gas from the flexible piping downstream from the restricting means;

second control means for controlling simultaneously the high pressure air and the adhesive to enable dispensing of the adhesive in a predetermined pattern; and closure means constructed and arranged for closing off the hermetically sealed coupling and the hermetically sealed conduit when the coupling and conduit are uncoupled from each other.

2. An apparatus for dispensing a liquid, comprising:

dispensing means for dispensing liquid;

supply means for supplying the liquid to be dispensed, the supply means comprising:

a hermetically sealed flexible bladder in which the liquid is disposed, a container for containing the flexible bladder, a hermetically sealed coupling extending from the flexible bladder through the container and providing a hermetically sealed conduit through which the liquid flows from the bladder;

elevating means for elevating the supply means above the dispensing means;

supporting means for supporting the hermetically sealed coupling at the elevating means;

first conveying means having a first flow path connected to the supply means and extending to the dispensing means;

second conveying means having a second flow path narrower than the first flow path and connected thereto for conveying the flow of the liquid from the first flow path to the dispensing means;

air supply means connected to said dispensing means;

first control means operatively associated with the dispensing means to control the dispensing of the liquid and the air supply in a predetermined pattern.

3. The apparatus according to claim 2, wherein the dispensing means comprises:

regulating means for regulating air supply to the dispensing means;

positioning means for positioning the air supply with respect to the liquid; and actuating means for simultaneously actuating the dispensing of the liquid and the air supply to form a predetermined spray pattern of the liquid.

4. The apparatus according to claim 2, wherein the air supply means is a high pressure air supply means having: control means for controlling the high pressure air supply.

5. The apparatus according to claim 2, wherein the supply means comprises:

an air vent in communication with the coupling.

6. The apparatus according to claim 2, wherein the container is rigid.

7. The apparatus according to claim 2, further comprising:

bleed means connected to the first conveying means for bleeding gas from where the first conveying means is connected to the second conveying means.

8. The apparatus according to claim 7, wherein the bleed means comprises:

a valve in communication with the first conveying means.

9. The apparatus according to claim 2, wherein the supporting means comprises:

a brace member positioned beneath the hermetically sealed coupling.

10. The apparatus according to claim 2, wherein the elevating means, comprises:

a platform having an upper surface at an elevation higher than the dispensing means.

11. The apparatus according to claim 2, wherein the first conveying means comprises:

a hermetically sealed vertically disposed conduit constructed and arranged as a riser for delivery of the liquid from the supply means to the dispensing means.

12. The apparatus according to claim 11, wherein the riser comprises:

piping;

indicator means in communication with the piping to indicate the flow of liquid;

second control means operatively associated with the piping to control the flow of the liquid, the second control means including a ball valve;

a quick disconnect coupling disposed between and interconnecting the hermetically sealed coupling of the container and the piping; and regulating means for regulating the flow of the liquid.

13. The apparatus according to claim 2, wherein the second conveying means is flexible for mobility of the second flow path.

14. The apparatus according to claim 2, further comprising:

a fitting interconnecting the first conveying means with the second conveying means, the fitting having a passageway therein for permitting the flow of the liquid from the first flow path to the second flow path.

15. The apparatus according to claim 14, wherein the passageway tapers in size to a diameter less than a diameter of the first flow path.

16. The apparatus according to claim 14, wherein the fitting is threaded for connection to the first conveying means.

17. The apparatus according to claim 14, further comprising:

a cincture to releasably connect the fitting with the first conveying means.

18. The apparatus according to claim 2, further comprising:

venting means connected to the first conveying means for venting gas from the first conveying means.

19. The apparatus according to claim 2, further comprising:

a valve in communication with the hermetically sealed conduit for venting gas from the hermetically sealed coupling and the hermetically sealed conduit.

20. The apparatus according to claim 2, wherein the dispensing means comprises a spray gun.

21. The apparatus according to claim 2, wherein the liquid comprises an adhesive.

22. The apparatus according to claim 2, further comprising:

closing means constructed and arranged for closing off the supply means and the first conveying means from the atmosphere to prevent gas and contaminants from entering the supply and first conveying means when the supply and first conveying means are disconnected from each other.

23. An apparatus for dispensing a liquid, comprising:

dispensing means for dispensing liquid;

supply means for supplying the liquid to be dispensed;

elevating means for elevating the supply means above the dispensing means;

first conveying means having a first flow path connected to the supply means and extending to the dispensing means;

second conveying means having a second flow path narrower than the first flow path and connected thereto for conveying the flow of the liquid from the first flow path to the dispensing means;

fitting means interconnecting the first conveying means with the second conveying means, the fitting means having a passageway therein for permitting the flow of the liquid from the first flow path to the second flow path;

cincture means to releasably connect the fitting means with the first conveying means;

air supply means connected to said dispensing means; and first control means operatively associated with the dispensing means to control the dispensing of the liquid and the air supply in a predetermined pattern.

24. An apparatus for dispensing a liquid, comprising:

dispensing means for dispensing liquid;

supply means for supplying the liquid to be dispensed;

elevating means for elevating the supply means above the dispensing means;

first conveying means having a first flow path connected to the supply means and extending to the dispensing means;

second conveying means having a second flow path narrower than the first flow path and connected thereto for conveying the flow of the liquid from the first flow path to the dispensing means;

air supply means connected to said dispensing means;

first control means operatively associated with the dispensing means to control the dispensing of the liquid and the air supply in a predetermined pattern; and closing means constructed and arranged for closing off the supply means and the first conveying means from the atmosphere to prevent gas and contaminants from entering the supply and first conveying means when the supply and first conveying means are disconnected from each other.

25. An apparatus for dispensing a liquid, comprising:

dispensing means for dispensing liquid;

supply means for supplying the liquid to be dispensed;

elevating means for elevating the supply means above the dispensing means;

conveying means having a first flow path connected to the supply means, and a second flow path narrower than the first flow path and connected thereto for conveying the flow of the liquid from the first flow path to the dispensing means;

air supply means connected to said dispensing means;

first control means operatively associated with the dispensing means to control the dispensing of the liquid and the air supply in a predetermined pattern.

26. A method for dispensing an adhesive, the method comprising the steps of:

supplying high pressure air to a dispensing means, including the steps of:

controlling the supply of high pressure air, regulating the supply of the high pressure air;

supplying adhesive to the dispensing means, including the steps of:

hermetically containing a supply of the adhesive in a flexible bladder, hermetically coupling the flexible bladder to the dispensing means;

elevating the supply of adhesive above the dispensing means;

conveying the adhesive from the hermetically sealed flexible bladder to the dispensing means, including the steps of:

venting gas from the flexible bladder and the hermetic coupling;

indicating the flow of adhesive from the adhesive supply, controlling the flow of adhesive from the adhesive supply, reducing a flow path for the adhesive to the dispensing means;

bleeding gas from the flow path;

regulating the amount of the adhesive to the dispensing means; and simultaneously dispensing adhesive and high pressure air to form a predetermined spray pattern of the adhesive.

27. A method for dispensing liquid, the method comprising the steps of:

supplying high pressure air to a dispensing means;

supplying liquid to the dispensing means through a flexible flow path, the step of supplying liquid including:

containing the supply of liquid, elevating the supply of liquid above the dispensing means to provide a known pressure head of the liquid, conveying the liquid through a relatively large flow path at a first relatively low velocity to a first point below the elevation of the supply of liquid to produce a constant pressure head, conveying the liquid through a flexible flow path relatively narrower than the first flow path at a relatively higher velocity;

bleeding gas from the liquid conveyed at a position downstream from where the relatively large flow path meets the relatively narrower flow path; and dispensing the liquid and the high pressure air to form a predetermined spray pattern of the liquid.

28. The method according to claim 27, wherein the liquid is hermetically contained and conveyed.

29. The method according to claim 27, wherein the liquid and the air are simultaneously dispensed.

30. The method according to claim 27, wherein the step of supplying high pressure air includes the steps of:

controlling the supply of high pressure air, and regulating the supply of high pressure air.

31. The method according to claim 27, wherein the step of supplying liquid to the dispensing means further includes the steps of:

indicating a flow of liquid from the liquid supply, controlling the flow of liquid from the liquid supply, and regulating the amount of the liquid to the dispensing means.

32. The method according to claim 27, further comprising the step of:

hermetically coupling the contained supply of liquid with the dispensing means.

33. The method according to claim 27, further comprising the step of:

venting gas from the liquid being conveyed to the dispensing means.

34. The method according to claim 27, wherein the liquid comprises an adhesive.

* * * * *